US005722721A

United States Patent [19]

Batoff et al.

[11] Patent Number: 5,722,721

[45] Date of Patent: Mar. 3, 1998

[54] POLE ADVERTISING SEAT

[76] Inventors: William W. Batoff; David L. Auspitz; Alan L. Levine, all of One Penn Center #1805, 1617 John F. Kennedy Blvd., Philadelphia, Pa. 19103

[21] Appl. No.: 755,344

[22] Filed: Nov. 22, 1996

[51] Int. Cl.[6] ..... A47C 9/00

[52] U.S. Cl. ..... 297/217.1; 297/451.5; 248/519; 108/150

[58] Field of Search ..... 297/423.38, 217.1, 297/451.4, 451.5; 108/91, 96, 109, 150; 248/314, 519; 211/107

[56] References Cited

U.S. PATENT DOCUMENTS

| | | | |
|---|---|---|---|
| 401,302 | 4/1889 | Purdy | 297/451.4 |
| 2,157,400 | 5/1939 | Cooper | 108/96 |
| 2,520,450 | 8/1950 | Austin, Jr. | 108/150 X |
| 3,000,512 | 9/1961 | Maynor | 312/108 |
| 3,278,229 | 10/1966 | Bates | 297/423.38 X |
| 3,620,174 | 11/1971 | Dentino | 108/151 |
| 3,626,871 | 12/1971 | McClendon | 108/151 |
| 3,920,295 | 11/1975 | Speckin | 312/108 |
| 4,334,482 | 6/1982 | Bolduc | 108/968 |
| 4,724,773 | 2/1988 | Newberry et al. | 108/150 |

*Primary Examiner*—Peter R. Brown

*Attorney, Agent, or Firm*—Patent & Trademark Services; Joseph H. McGlynn

[57] ABSTRACT

A seat or bench which is readily mounted over a pole or column, and means for supporting the seat or bench. The device requires no assembly at the site of mounting to pole or column, and is readily placed over the pole or column, thus making it extremely easy to mount. The device is composed of a seat or bench in any shape, and a connected supporting sleeve. The sleeve is connected to the seat, and is circular and hollow in nature. In use, the sleeve is placed over a similarly-shaped pole or column, positioned so that one end rests on the ground, while the seat portion is adjacent to an upper portion of the pole or column. In this way, the seat is supported by the sleeve and existing pole or column.

3 Claims, 1 Drawing Sheet

POLE ADVERTISING SEAT

BACKGROUND OF THE INVENTION

This invention relates generally to seats and benches and, more particularly to seats that may be mounted on poles.

DESCRIPTION OF THE PRIOR ART

Numerous inventions relating to mountable platforms have been proposed in the prior art. Often, they seek to secure a flat area for use as a bench, shelf or seat around a pole. U.S. Pat. No. 3,620,174 discloses a table securable to a conventional pole lamp. The table comprises two semi-circular panels which may be clamped individually around the pole so to form semi-circular tables, or else clamped together around the pole so to form a circular table.

U.S. Pat. No. 3,626,871 discloses a platform or seat assembly for placement about a pole or post. The device comprises a substantially annular platform able to be positioned with its center opening surrounding the pole, and a framework able to be positioned beneath the platform and around the pole for supporting the platform.

U.S. Pat. No. 3,000,512 discloses a table or shelf which utilizes existing posts or underpinnings in basements. The tables or shelves may be of the type which can be readily folded up when not being used so that the entire assembly will occupy a minimum amount of space for storage when not being used.

U.S. Pat. No. 3,920,295 discloses a column mounted tool holder. A typical basement or factory support column is utilized for mounting of two complimentary shaped structural members. When bolted together, the two members form a work area completely surrounding a column.

Most of the prior art mounted tables and shelves have aimed to mount shelves through the use of multiple piece assemblies, or by imposing shears and stresses on the mounting column or pipe. There remains a need for a device which places no stresses on the mounting column or pipe, and which is readily assembled before placement on the pole.

SUMMARY OF THE INVENTION

The present invention comprises a seat or bench which is readily mounted over any circular pole or column, and means for supporting the seat or bench. The device requires no assembly at the site of mounting to the pole or column, and is readily placed over the pole or column, thus making it extremely easy to mount.

The device is composed of a seat or bench in any shape, and a connected supporting sleeve. The sleeve is connected to the seat, and is circular and hollow in nature. In use, the sleeve is placed over a similarly-shaped pole or column, positioned so that one end rests on the ground, while the seat portion is adjacent to pole or column. In this way, the seat is supported by the sleeve and existing pole or column.

Accordingly, it is an object of this invention to provide a self-supporting seat or bench which is mounted to a pole or column.

It is a further object of this invention that device be easily mounted, without the use of tools and requiring minimal strength.

Finally, it is an object of this device to provide a space for designs, such as advertising, to be mounted on the seat or bench.

DESCRIPTION OF THE PREFERRED EMBODIMENT

Figure 1:
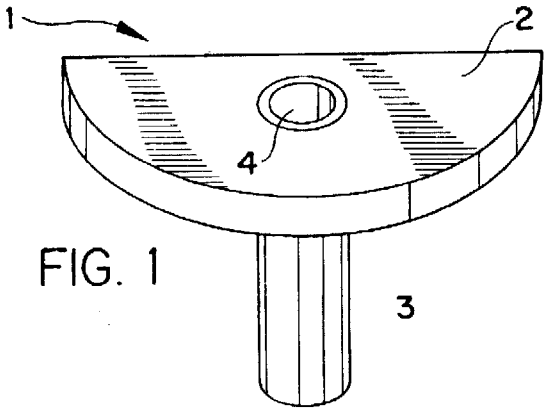
FIG. 1 shows a perspective view of the invention.

Referring now to the drawings, there is shown in FIG. 1 the present invention 1 comprising a semi-circular seat region 2 and an attached hollow sleeve 3. The sleeve 3 consists of a length of material in a hollow, cylindrical form, with an inner and outer diameter. The semi-circular piece 2 composes the top of the invention and has in it a hole 4 the same size as the outer diameter of the sleeve 3. The sleeve 3 is connected at one end to the underside of the semi-circular piece 2, while left free at the other end, thereby forming the bottom of the invention.

Figure 2:
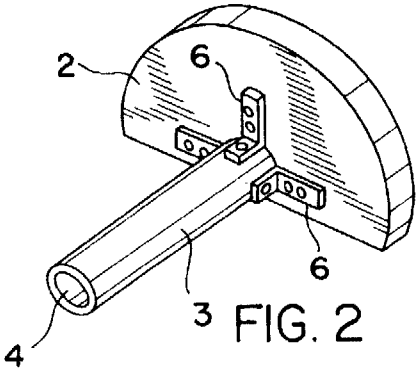
FIG. 2 shows a perspective view of the invention's underside.
Figure 3:
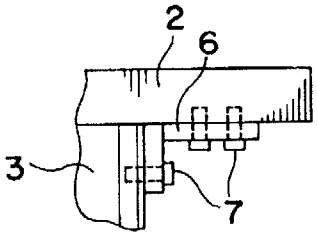
FIG. 3 shows a side view of the invention's underside and a joining piece.

FIG. 2 shows the underside of the invention 1 and the nature of the connection between the semi-circular piece 2 and the sleeve 3. A piece of metal 6 with a plurality of small holes 11 and a substantially right angle bend is employed to make connection. This piece 6 is positioned so that one arm is adjacent to the sleeve 3, while the other arm runs along the under side of the semi-circular piece 2. In each of the small holes is driven a screw or nail 7, to secure the semi-circular piece 2 to the sleeve 3. The heads of the screw or nail 7 is larger than the hole 11, as shown in FIG. 3. In this manner, the metal piece 6 is attached to both the sleeve 3 and the semi-circular piece 2, thereby, owing to the continuous nature of the metal piece 6, joining the two pieces together. This connection is made so that the hollow portion of the sleeve 3 is aligned with the hole 4 in the semi-circular region 2. A plurality of these metal pieces 6 is used to reinforce this connection.

Figure 4:
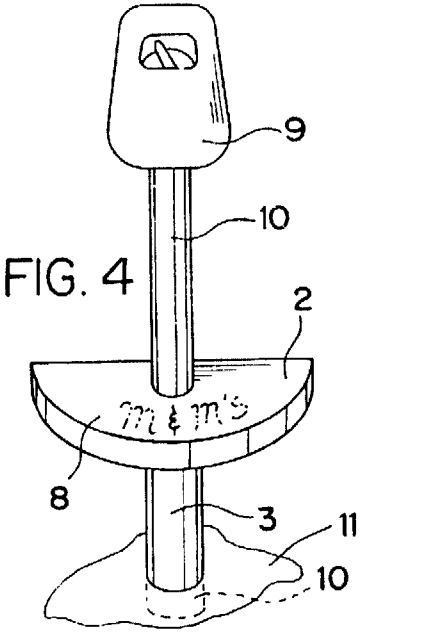
FIG. 4 shows a perspective view of the invention as it rests on the ground over a parking meter pole.

In use, the invention 1 is placed over a parking meter pole 10, as shown in FIG. 4. This result is easily achieved by removing the meter 9, and placing the hollow portion of the sleeve 3 over the pole 10, thus allowing the invention 1 to slide down the pole 10 until the bottom of the sleeve 3 hits the ground or supporting surface 11.

Figure 5:
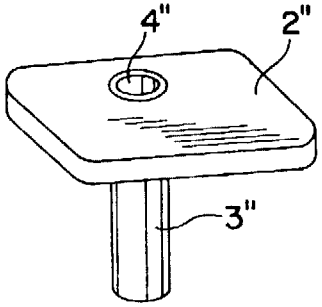
FIGS. 5 and 6 shows perspective views of the invention with different shaped seats.
Figure 6:
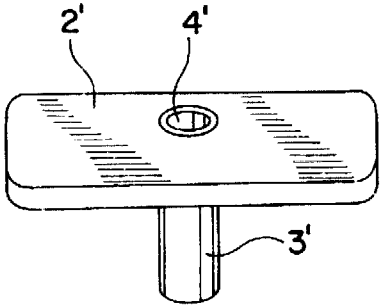

A person desiring a place to sit may use the semi-circular piece 2 as a seat, though piece could act as a shelf or table as well. Also, seat 2 may have on its upper face a design 8, such as a decoration or advertisement. Furthermore, while this invention has been described with the use of a semi-circular piece 2 as a seat, it is to be understood that this invention includes the use of different shapes of the piece 2, including, but not limited to, an elliptical shape (see 2' in FIG. 6 which is attached to a pole 3' through an aperture 4') or a rectangular shape (see 2" in FIG. 5 which is attached to a pole 3" through an aperture 4").

Also, the device may be mounted over any type of pole 10 (i.e. the pole could be square or rectangular), and would merely require the shape of the sleeve 3 to be of a similar shape and size.

As for composition, this invention may employ many different materials, though the materials are to be chosen on the basis of their adherence to the design and performance conditions discussed herein. The seat 2 must be able to withstand the stresses and shears associated with the normal action of a person sitting or resting on it. A strong, thick piece of wood would be ideal, though metal or a strong plastic, or other suitable material, might also be acceptable. The sleeve 3 must be sufficiently strong to resist the large compressive forces exerted upon it as a person sits on the seat. Also, the inner diameter of the sleeve 3 must be at least slightly larger than the outside diameter of the pole 10, so as to allow the sleeve 3 to pass over the pole 10, though not so large that the invention will have unnecessary movement after it is mounted over the pole 10. Again, a strong metal or plastic would be ideal, though other materials may be suitable.

The joining pieces 6 must also be sufficiently strong to resist the large stresses required to join the seat 2 and sleeve 3. That is, the substantially right angle in piece 6 must be able to resist the tendency to bend as it is loaded by a person sitting on the seat 2. Again, a strong metal would be ideal, though other materials might also be suitable. Finally, the designs 8 on the seat 2 could be of virtually any form. These designs could be painted or affixed by an adhesive onto the seat, which might have a cover, such as a lamination, to protect the designs from deterioration.

In an alternate form, the invention might be composed of a single, continuous piece of injection molded plastic. Injection molding is a plastic molding procedure whereby heat softened plastic material is forced under very high pressure into a metal cavity mold which is relatively cool. Acceptable metals for the mold are aluminum and steel. The inside cavity of the mold is comprised of two or more halves, and is the same desired shape as the product to be formed. High pressure hydraulics are used to keep the mold components together during the actual injection phase of the molding process. The injected plastic is allowed to cool and harden. The hydraulics holding the multiple component cavity together are released, the halves of the mold are separated and the solid formed plastic item is removed. Injection molding can be a highly automated process and is capable of producing extremely detailed parts at a very cost effective price. The nature and mutual relationship of the seat 2 and sleeve 3 would be identical to the previously discussed form, though such a continuous construction would remove the need for the joining piece assembly composed of joining pieces 6 and screws or nails 7.

Although the pole-mounted seat and the means of using the same according the present invention have been described in the foregoing specification with considerable detail, it is to be understood that modifications may be made to the invention which do not exceed the scope of the appended claims, and modified forms of the present invention done by others skilled in the art to which the invention pertains will be considered infringements of the invention when those modified forms fall within the claimed scope of this invention.

What we claim as our invention is:

1. A seat in combination with a vertical support comprising:

said vertical support having a top and a bottom portion and a vertical, longitudinal axis, said bottom portion of said vertical support being attached to a supporting surface, said seat comprising a horizontal support having a top surface and a bottom surface, said horizontal support having only a single aperture extending therethrough, said horizontal support having means for attachment to said vertical support, said top and bottom surfaces of said seat extending perpendicular to said longitudinal axis of said vertical support, said means for attachment to said vertical support comprising a hollow sleeve fixedly positioned within said single aperture, said sleeve extending from said top surface to said bottom surface of said seat, and then beyond said bottom surface, said sleeve having a top and a bottom surface, said bottom surface of said sleeve engaging said supporting surface when said sleeve is engaged with said vertical support, whereby said sleeve can be passed over said vertical support until said bottom surface of said sleeve rests on said supporting surface and said sleeve will thereby support said horizontal support.

2. The seat as claimed in claim 1, wherein a brace is attached to said bottom surface and to said sleeve adjacent to said bottom surface.

3. The seat as claimed in claim 1, wherein said top surface has advertisement placed thereon.

* * * * *